US008662248B2

(12) United States Patent
Bean

(10) Patent No.: US 8,662,248 B2
(45) Date of Patent: Mar. 4, 2014

(54) SOUND ATTENUATION STUD

(75) Inventor: Stephen Charles Bean, Shailor Park (AU)

(73) Assignee: Peer Intellectual Properties Pty Ltd., Beenleight (AU)

( * ) Notice: Subject to any disclaimer, the term of this patent is extended or adjusted under 35 U.S.C. 154(b) by 0 days.

(21) Appl. No.: 13/578,983

(22) PCT Filed: Mar. 15, 2011

(86) PCT No.: PCT/AU2011/000287

§ 371 (c)(1),
(2), (4) Date: Aug. 14, 2012

(87) PCT Pub. No.: WO2011/116409

PCT Pub. Date: Sep. 29, 2011

(65) Prior Publication Data

US 2013/0008740 A1 Jan. 10, 2013

(30) Foreign Application Priority Data

Mar. 24, 2010 (AU) ..... 2010901257

(51) Int. Cl.
*E04B 1/00* (2006.01)

(52) U.S. Cl.
USPC ..... 181/285

(58) Field of Classification Search
USPC ..... 181/285; 52/210
See application file for complete search history.

(56) References Cited

U.S. PATENT DOCUMENTS

| | | | | |
|---|---|---|---|---|
| 1,852,002 | A * | 4/1932 | Mills | 52/347 |
| 4,986,051 | A * | 1/1991 | Meyer et al. | 14/74.5 |
| 5,260,525 | A * | 11/1993 | Morse | 181/285 |
| 5,809,717 | A * | 9/1998 | Scarborough et al. | 52/281 |
| 6,427,407 | B1 * | 8/2002 | Wilson | 52/481.1 |
| 7,647,744 | B2 * | 1/2010 | Payne, Jr. | 52/770 |
| 8,225,581 | B2 * | 7/2012 | Strickland et al. | 52/850 |
| 2002/0078655 | A1 * | 6/2002 | Montanaro et al. | 52/693 |
| 2006/0144005 | A1 * | 7/2006 | Tonyan et al. | 52/653.1 |

FOREIGN PATENT DOCUMENTS

| | | | |
|---|---|---|---|
| JP | 10-002049 | A | 1/1998 |
| JP | 2002-167894 | A | 6/2002 |

* cited by examiner

*Primary Examiner* — Forrest M Phillips
(74) *Attorney, Agent, or Firm* — Boyle Fredrickson, S.C.

(57) ABSTRACT

The present invention relates to a sound attenuation stud. The stud includes two engagement portions for engaging within a building element. The stud also includes two sound attenuation formations located between the engagement portions. Each sound attenuation formation includes a first portion relative to which second and third portions extend. Preferably, each portion is either parallel or orthogonal with all the other portions.

22 Claims, 3 Drawing Sheets

SOUND ATTENUATION STUD

TECHNICAL FIELD

The present invention relates to a sound attenuation stud.

BACKGROUND

The reference to any prior art in this specification is not, and should not be taken as an acknowledgement or any form of suggestion that the prior art forms part of the common general knowledge.

In buildings such as high rise apartment blocks, sound (esp. noise) undesirably carries between building elements such as hollow walls, ceilings or floors that can separate rooms.

AU 2004203463 discloses a sound attenuation stud for engaging within a building element. The stud includes a sound attenuation formation which substantially deforms in use to provide sound attenuation.

The preferred embodiment of the present invention provides a more structurally stable sound attenuation stud.

SUMMARY OF THE INVENTION

According to one aspect of the present invention, there is provided a sound attenuation stud including two engagement portions for engaging within a building element and two sound attenuation formations located between the engagement portions, each sound attenuation formation including a first portion relative to which second and third portions extend, wherein the second and third portions are less than half the length of the engagement portions.

For a given stud thickness, the lengths of the first, second and third portions may be small enough to resist substantial deformation in use to thereby provide a structurally stable sound attenuation stud. The stud may engage with another like stud to form a box-like beam which also resists deformation.

Preferably, the second and third portions extend orthogonally from the first portion.

Preferably, the sound attenuation stud includes exactly two sound attenuation formations. The second and third portions of a first one of the sound attenuation formations may be of greater length than the second and third portions of a second one of the sound attenuation formations. The first portion of a first one of the sound attenuation formations may be of greater length than the first portion of a second one of the sound attenuation formations.

In one embodiment, the sound attenuation stud further includes a bridge portion bridging the two sound attenuation formations. The sound attenuation stud may further include a pair of interconnection portions interconnected between respective engagement portions and sound attenuation formations. The bridge portion and interconnection portions may be co-linear. The sound attenuation stud may further include a pair of lip portions inwardly extending from respective engagement portions.

Each portion may be generally straight, with each adjacent portion pair interconnecting in a curved manner. Each portion may be either parallel or orthogonal with all the other portions. The stud may be roll formed from metal or extruded from non-metallic material (e.g. polymeric material). The stud may be of uniform thickness.

According to another aspect of the present invention, there is provided a sound attenuation stud including two engagement portions for engaging within a building element, and two sound attenuation formations, each sound attenuation formation including a first portion relative to which second and third portions extend, wherein the second and third portions are less than half the length of the engagement portions.

According to another aspect of the present invention, there is provided a box-like beam including two of the studs engaged together. The engagement portions may be of different length to facilitate mating of the studs together.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
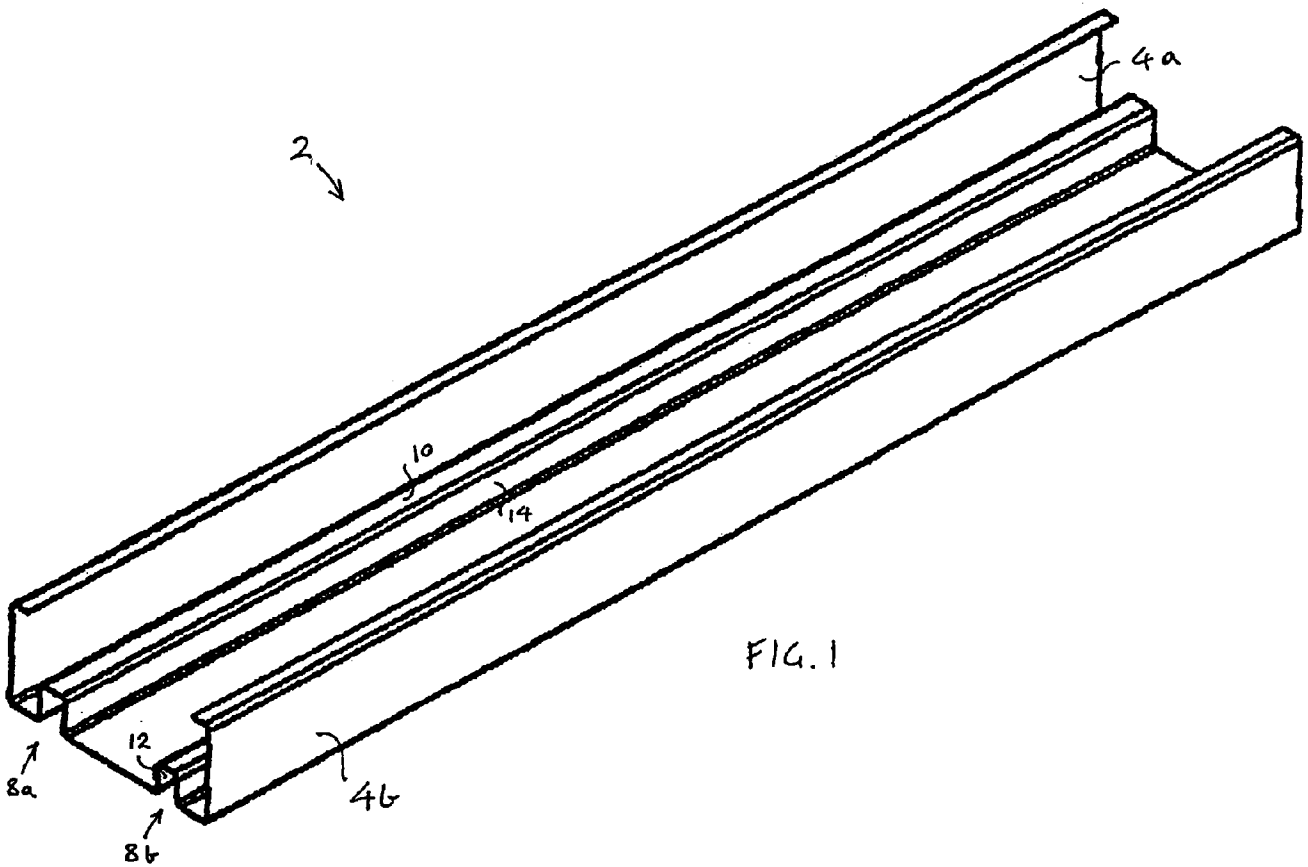
FIG. 1 is a perspective view of a sound attenuation stud in accordance with an embodiment of the present invention.
Figure 2:
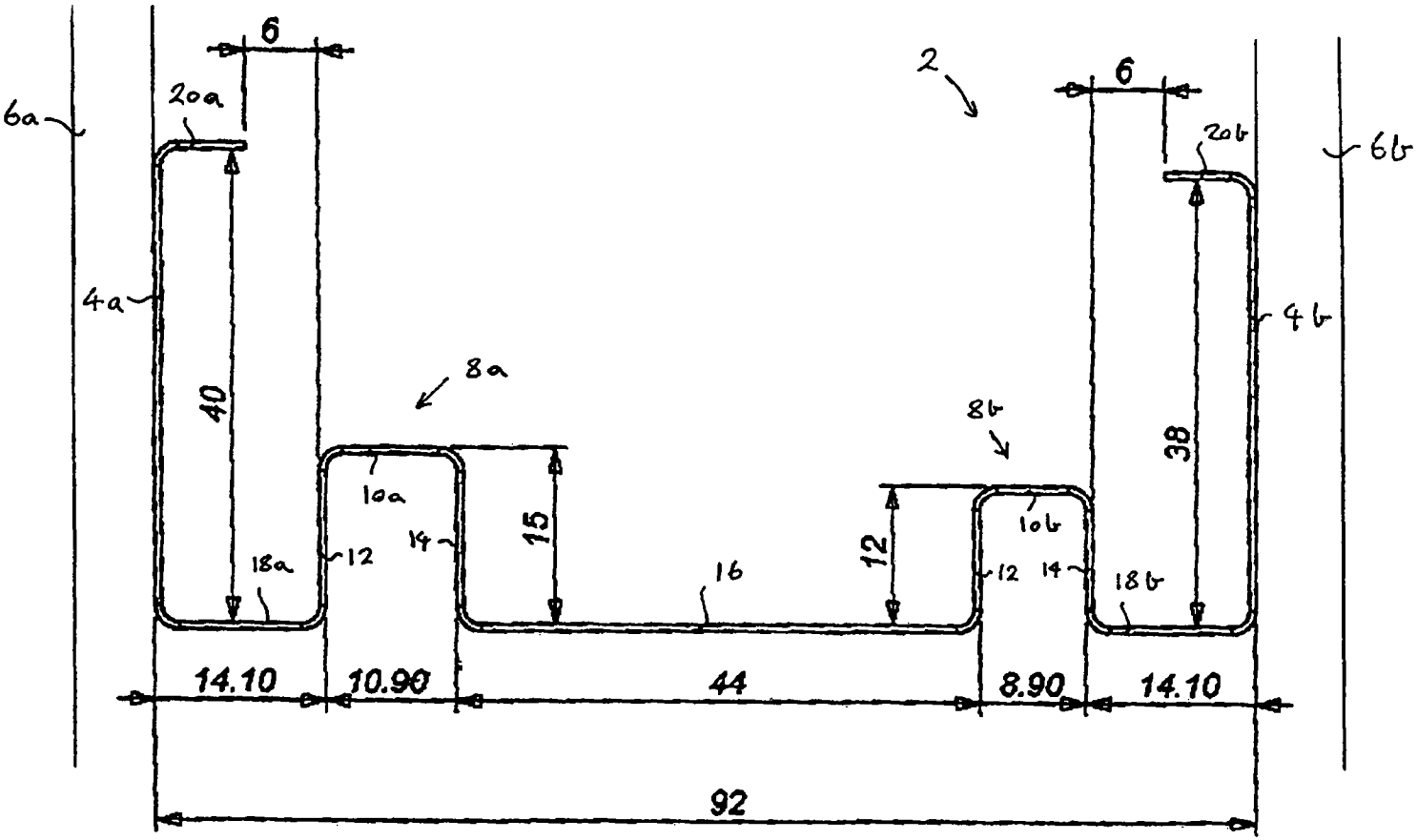
FIG. 2 is an end sectional view of the sound attenuation stud of FIG. 1 engaged within a wall, with all dimensions shown in millimetres.

According to an embodiment of the present invention, there is provided an extruded metal (e.g. steel or aluminium) sound attenuation stud 2 as shown in FIGS. 1 and 2. As can best be seen in FIG. 2, the stud 2 includes two engagement portions 4*a*, 4*b* for engaging within a hollow building wall having two (or more) sheets of plasterboard 6*a*, 6*b*. The stud 2 includes exactly two sound attenuation formations 8*a*, 8*b* located between the engagement portions 4*a*, 4*b*. Each sound attenuation formation 8 includes a first portion 10 relative to which a second portion 12 and a third portion 14 orthogonally extend. The stud 2 is of uniform thickness, and the lengths of the first, second and third portions 10, 12, 14 are small enough to resist substantial deformation in use to thereby provide a structurally stable sound attenuation stud 2. A detailed description of the stud 2 is provided below.

With particular reference to FIG. 2, the second and third portions 12, 14 of a first sound attenuation formation 8*a* are of greater length than the second and third portions 12, 14 of a second sound attenuation formation 8*b*. Further, the second and third portions 12, 14 are less than half the length of the engagement portions 4*a*, 4*b*. In addition, the first portion 10 of the first sound attenuation formation 8*a* is of greater length than the first portion 10 of the second sound attenuation formation 8*b*.

The sound attenuation stud 2 further includes a bridge portion 16 bridging the two sound attenuation formations 8*a*, 8*b*. Further, the sound attenuation stud 2 further includes a pair of interconnection portions 18*a*, 18*b* interconnecting respective engagement portions 4 and sound attenuation formations 8. The bridge portion 16 and interconnection portions 18*a*, 18*b* are co-linear. The sound attenuation stud 2 further includes a pair of lip portions 20*a*, 20*b* inwardly extending from respective engagement portions 4*a*, 4*b*.

Each portion 4, 10, 12, 14, 16, 18, 20 is generally straight, with each adjacent portion pair interconnecting in a curved manner. Each portion 4, 10, 12, 14, 16, 18, 20 is either parallel or orthogonal with all the other portions.

Figure 3:
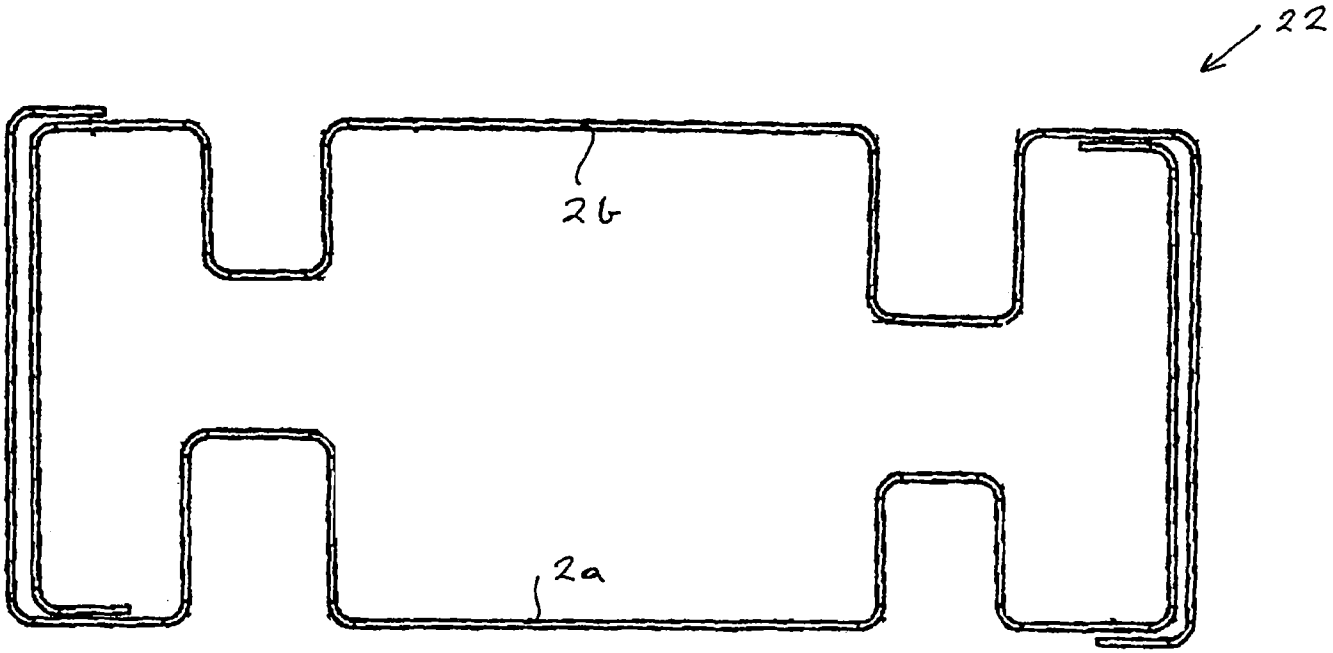
FIG. 3 is a box-like beam formed by engaging two like sound attenuation studs of FIG. 1.

FIG. 3 shows a box-like beam 22 including two of the studs 2 nested and engaged together. Like the constituent studs 2 themselves, the box-like beam 22 is also structurally stable and resists deformation. The engagement portions 4*a*, 4*b* are of different length to facilitate mating of the studs 2*a*, 2*b* together.

A person skilled in the art will appreciate that many embodiments and variations can be made without departing from the ambit of the present invention.

Applicant has found that the stud 2 shown in FIGS. 1 and 2 has dimensions which provide desirable sound attenuation properties whilst maintaining a desired degree of structural stability in use. A first engagement portion 4 has a length of about 40 mm, a second engagement portion 4*b* has a length of about 38 mm, the first portion 10*a* of the first sound attenuation formation 8*a* has a length of about 10.90 mm, the first portion 10*b* of the second sound attenuation formation 8*b* has a length of about 8.90 mm, the second and third portions 12*a*, 14*a* of the first sound attenuation formation 8*a* each have lengths of about 15 mm, the second and third portions 12*b*, 14*b* of the second sound attenuation formation 8*b* each have lengths of about 12 mm, the bridge portion 16 has a length of about 44 mm, interconnection portions 18*a*, 18*b* each have lengths of about 14.10 mm and the lip portions 20*a*, 20*b* each have lengths of about 8.10 mm (i.e. 14.10 mm-6.00 mm). It will be appreciated that these portion lengths can be readily modified as required.

In one embodiment, the stud 2 may be formed from sheet metal. In another embodiment, the stud may be extruded from material other than metal (e.g. polymeric material).

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

The claims defining the invention are as follows:

1. A sound attenuation stud including two engagement portions for engaging within a building element and two sound attenuation formations located between the engagement portions, each sound attenuation formation including a first portion relative to which second and third portions extend.

2. A sound attenuation stud as claimed in claim 1 and having a uniform thickness, the lengths of the first, second and third portions being small enough to resist substantial deformation in use to thereby provide a structurally stable sound attenuation stud.

3. A sound attenuation stud as claimed in claim 1, wherein the stud is shaped to engage with another like stud to form a box-like beam which resists deformation.

4. A sound attenuation stud as claimed in claim 1, wherein the second and third portions extend orthogonally from the first portion.

5. A sound attenuation stud as claimed in claim 1, wherein the sound attenuation stud includes exactly two sound attenuation formations.

6. A sound attenuation stud as claimed in claim 1, wherein the second and third portions of a first one of the sound attenuation formations is of greater length than the second and third portions of a second one of the sound attenuation formations.

7. A sound attenuation stud as claimed in claim 1, wherein the second and third portions are less than half the length of the engagement portions.

8. A sound attenuation stud as claimed in claim 1, wherein the first portion of a first one of the sound attenuation formations is of greater length than the first portion of a second one of the sound attenuation formations.

9. A sound attenuation stud as claimed in claim 1, further including a bridge portion bridging the two sound attenuation formations.

10. A sound attenuation stud as claimed in claim 9, further including a pair of interconnection portions interconnected between respective engagement portions and sound attenuation formations.

11. A sound attenuation stud as claimed in claim 10, wherein the bridge portion and interconnection portions are co-linear.

12. A sound attenuation stud as claimed in claim 1, further including a pair of lip portions inwardly extending from respective engagement portions.

13. A sound attenuation stud as claimed in claim 1, wherein each portion is generally straight, with each adjacent portion pair interconnecting in a curved manner.

14. A sound attenuation stud as claimed in claim 1, wherein each portion is either parallel or orthogonal with all the other portions.

15. A sound attenuation stud including two sound attenuation formations, each sound attenuation formation including a first portion relative to which second and third portions extend.

16. A sound attenuation stud as claimed in claim 15, wherein the sound attenuation portions are interconnected by a bridge portion.

17. A sound attenuation stud as claimed in claim 16, further including: a pair of engagement portions for engaging within a building element; and a pair of interconnection portions interconnected between respective engagement portions and sound attenuation formations.

18. A sound attenuation stud as claimed in claim 17, wherein each portion is either parallel or orthogonal with all the other portions.

19. A sound attenuation stud as claimed in claim 15 and having a uniform thickness, the lengths of the first, second and third portions being small enough to resist substantial deformation in use to thereby provide a structurally stable sound attenuation stud.

20. A sound attenuation stud as claimed in claim 11, wherein one of the sound attenuation formations is of greater length than the other one of the sound attenuation formations.

21. A sound attenuation stud comprising:

a pair of engagement portions for engaging within a building element;

a pair of sound attenuation formations located between the pair of engagement portions, each sound attenuation formation comprised of a first portion from which second and third portions outwardly extend, and wherein one of the sound attenuation formations is of greater length than the other one of the sound attenuation formations;

a bridge portion bridging the pair of sound attenuation formations; and a pair of interconnection portions interconnected between respective engagement portions and sound attenuation formations; and wherein the bridge portion and interconnecting portions are substantially co-linear.

22. A sound attenuation stud as claimed in claim 21, wherein the sound attenuation stud is shaped to engage with another one of the sound attenuation studs forming a box-like beam.

* * * * *